United States Patent [19]

Blumberg et al.

[11] Patent Number: 4,993,861

[45] Date of Patent: Feb. 19, 1991

[54] FILE FOLDER AND METHOD OF MANUFACTURE

[75] Inventors: Murray B. Blumberg, Woodmead Springs Sandton, South Africa; William M. Hoffman, Hamilton, Ohio

[73] Assignee: Technokantoor, Ltd., Brussels, Belgium

[21] Appl. No.: 433,592

[22] Filed: Nov. 8, 1989

[51] Int. Cl.[5] ..... B42F 13/06; B42F 13/08

[52] U.S. Cl. ..... 402/8; 402/14; 402/18

[58] Field of Search ..... 402/8, 14, 15, 18

[56] References Cited

U.S. PATENT DOCUMENTS

| | | | |
|---|---|---|---|
| 421,028 | 2/1890 | Jones | 402/14 |
| 910,194 | 1/1909 | Harris | 402/14 |
| 1,096,181 | 5/1914 | Mieden | 402/14 |
| 1,138,872 | 5/1915 | Hub, Jr. | 402/18 |
| 1,500,339 | 7/1924 | Smiley, Jr. | 402/14 |
| 1,577,558 | 3/1926 | Brown et al. | 402/14 |
| 1,652,205 | 12/1927 | Kline | 402/14 |
| 1,665,128 | 4/1928 | Cather | 402/14 |
| 1,665,705 | 4/1928 | Kline | 402/14 |
| 1,744,948 | 1/1930 | Buckland | 402/14 |
| 1,912,182 | 5/1933 | Girolamo et al. | 402/14 |
| 1,930,648 | 10/1933 | Kline | 402/14 |
| 2,005,717 | 6/1935 | Coulston | 402/14 |
| 2,265,404 | 12/1941 | Stark | 402/14 |
| 2,336,619 | 12/1943 | Karlen | 402/14 |
| 2,596,600 | 5/1952 | Rice | 402/14 |
| 2,725,881 | 12/1955 | Goldman | 402/14 |
| 3,271,829 | 9/1966 | Corey | 402/14 |
| 4,192,620 | 3/1980 | Jahn | 402/14 |
| 4,285,104 | 8/1981 | Corey et al. | 402/14 |

FOREIGN PATENT DOCUMENTS

| | | | |
|---|---|---|---|
| 220340 | 8/1957 | Australia | 402/14 |
| 1128839 | 5/1962 | Fed. Rep. of Germany | 402/14 |

*Primary Examiner*—Paul A. Bell

*Attorney, Agent, or Firm*—Wood, Herron & Evans

[57] ABSTRACT

A file folder and fastener combination wherein the folder has a major flap along one edge of the folder and a pair of spaced, colinearly aligned, elongated minor flaps formed in said folder or major flap and separated by a medial portion of the folder or major flap. The fastener has a central body portion overlying one surface of the medial portion of the folder or major flap. Elongated prongs extend from opposite ends of the central body portion of the fastener and overlie the minor flaps of the folder or major flap on the opposite surface of the folder or major flap from the surface upon which the central portion of the fastener is located. The major flap of the folder is folded against the folder and secured thereto so as to sandwich the central portion of the fastener between the folder and the major flap. Alternatively, instead of a major flap formed on one edge of the folder, the central body portion of the fastener may be covered by a separate strip of material.

8 Claims, 2 Drawing Sheets

FILE FOLDER AND METHOD OF MANUFACTURE

This application is related to and discloses a variation of the invention disclosed in the assignee's co-pending U.S. patent application Ser. No. 07/215,604, filed July 6, 1988, now U.S. Pat. No. 4,950,097.

This invention relates to file folders and, more particularly, to file folders of the type which have metal fasteners connected thereto for securing loose papers to the file folders.

BACKGROUND OF THE INVENTION

Cardboard files or file folders are commonly used in combination with metal fasteners for securing loose papers to or within the folder. Generally, such fasteners comprise an elongated central body with elongated prongs extending from opposite ends of the central body. These fasteners are generally supplied to consumers either separately from the cardboard folders, or, alternatively, with the fastener attached to the file folder. In either event, in order to assemble the fastener to the file folder, it is necessary to bend the prongs into a position normal or perpendicular to the elongated body, and then push the prongs through slots in the folder so that the body of the fastener is located on the outside of the file with the prongs extending into the inside of the folder. The prongs are then bent down against the insider surface of the file folder so as to secure the fastener to the file and facilitate closure of the folder.

One shortcoming of file folders and fasteners of the type wherein the fastener is attached to the folder prior to sale of the folder to the consumer is that assembly of the fastener to the folder is expensive and requires expensive equipment to effect the assembly. The expense is primarily attributable to the necessity to form the fastener as a flat sheet of material, to bend it so that the prongs of the fastener are located normal to the central body portion of the fastener, to push the prongs of the fastener from the outside of the folder through slots or openings in the folder and to then bend the prongs of the fastener down against the inside of the folder.

It has therefore been one objective of this invention to provide a new and improved file folder and fastener combination which may be manufactured and assembled much less expensively than heretofore possible.

Another objective of this invention has been to provide a new and improved file folder and fastener combination in which the fastener may be attached to the folder without the necessity to bend the end prongs of the fastener normal to the central body portion of the fastener in order to effect the attachment.

Another problem characteristic of all file folder and fastener combinations is that the central body portion of the fastener which is located on the outside or exposed side of a file folder tends to catch or hang up on adjacent file folders when multiple file folders are filed in a filing cabinet. This results in damage to the files and inconvenience in filing multiple files.

It has therefore been another objective of this invention to provide an improved file folder and fastener combination which avoids the problem of the central portion of a fastener hanging up on and damaging adjacent files contained in a common file cabinet.

SUMMARY OF THE INVENTION

The file folder and fastener combination of this invention which achieves these objectives comprises a folder having a major flap along the top or side of the folder and a pair of spaced, colinearly aligned, elongated minor flaps formed in the major flap and separated by a medial portion of the major flap. A fastener having a central body portion and a pair of opposed elongated prongs extending from opposite ends of the central body portion is mounted on the major flap with the central body portion of the fastener overlying the inside surface of the medial portion of the major flap with the prongs of the fastener overlying the outside surface of the minor flaps of the folder. The fastener is secured to the folder by folding and securing the inside surface of the major flap against the inside surface of the folder such that the medial portion of the fastener is sandwiched between the inside surface of the folder and the inside surface of the major flap with the prongs of the fastener resting against the outside surface of the minor flaps. The inside surface of the major flap is preferably secured to the inside surface of the folder by adhering the inside surfaces of the minor flap and inside surfaces of the major flap to the inside surface of the folder.

As an alternative to mounting the fastener on the flap and then securing the inside surface of the flap to the inside surface of the folder with the medial portion of the fastener sandwiched therebetween, the fastener may be mounted on the folder with the outside surface of the folder secured to the outside surface of the flap and the medial portion of the fastener sandwiched therebetween. In that event, the folder would have a major flap along the top or side of the folder and a pair of spaced, colinearly aligned, elongated minor flaps formed in the folder adjacent the major flap. The fastener having a central body portion and a pair of opposed elongated prongs extending from opposite ends of the central body portion is mounted upon the folder with the central body portion of the fastener overlying the outside surface of the medial portion of the folder and with the prongs of the fastener overlying the inside surface of the minor flaps of the folder. The fastener is secured to the folder by folding and securing the outside surface of the major flap against the outside surface of the folder such that the medial portion of the fastener is sandwiched between the outside surface of the folder and the outside surface of the major flap and the prongs of the fastener rest against the inside surface of the minor flaps. In this alternative embodiment, the outside surface of the folder is preferably secured to the outside surface of the major flap by adhesive.

Irrespective of whether the fastener is attached to the folder or to a flap of the folder, the novel fastener and folder combination of this invention lends itself to a novel method of assembling the fastener and folder and securing the fastener to the folder. This method is substantially less expensive than prior methods of manufacturing and assemblying folders and fasteners.

According to the practice of this method, the spaced, colinearly aligned, elongated minor flaps are scored in either the folder or the major flap and folded from the plane of the folder or flap from which the minor flap is formed. The fastener, with its prongs displaced slightly from the plane of the medial portion, is then moved generally parallel to the surface of the folder or flap until the prongs of the fastener enter the opening between the minor flaps and the major flap or folder from which the minor flaps are scored and folded. During this movement of the fastener relative to the major flap or folder, the central portion of the fastener is positioned over the medial portion of the major flap or folder. So positioned, the fastener may be permanently sandwiched between the major flap and folder by folding the flap against the folder and securing the two together with the medial portion of the fastener secured therebetween.

The primary advantage of this method of assembling the fasteners and folders is that it may all be accomplished mechanically with relatively simple and inexpensive machinery.

The invention of this application eliminates the need for bending of the end prongs of the fastener normal to the central or medial portion of the fastener in order to effect assembly of the fastener to the folder. Consequently, there is a substantial savings in the cost of manufacturing and assembling the folder and fastener.

These and other objects and advantages of this invention will be more readily apparent from the following description of the drawings in which.

Figure 1:
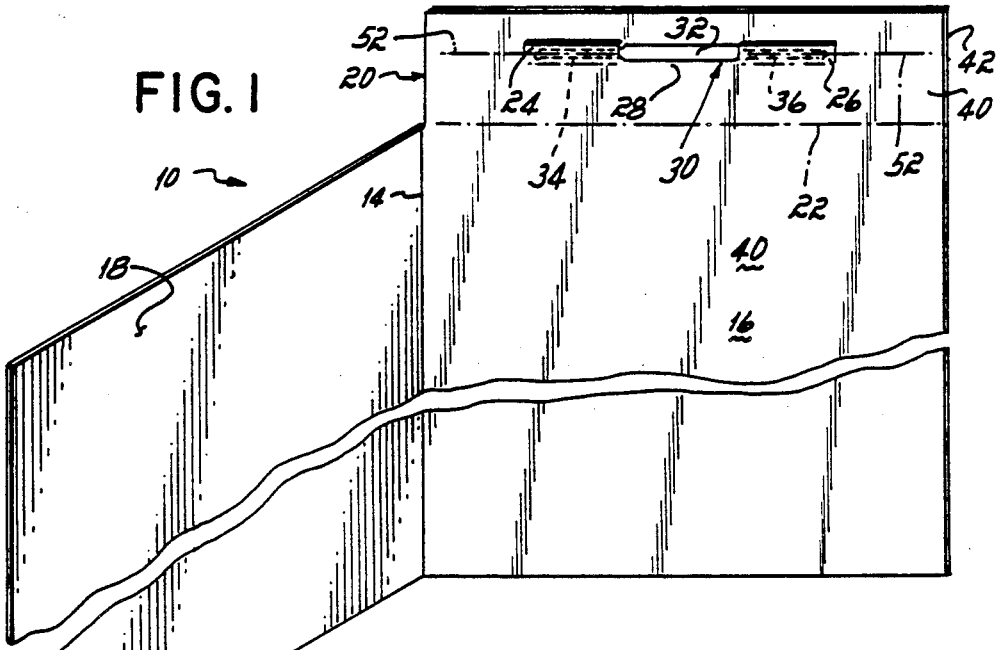
FIG. 1 is a perspective view, partially assembled, of a file folder and fastener combination incorporating the invention of this application.
Figure 2:
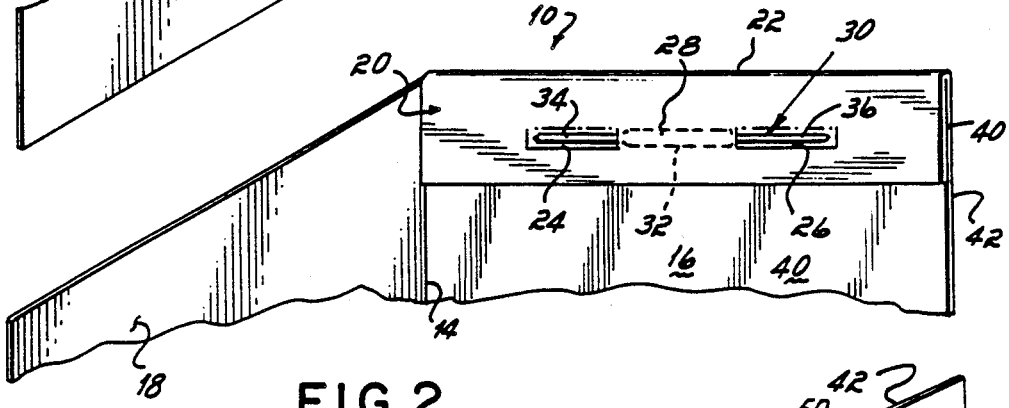
FIG. 2 is a view similar to FIG. 1 of the top portion of the folder and fastener combination of FIG. 1, but with the combination completely assembled.
Figure 3:
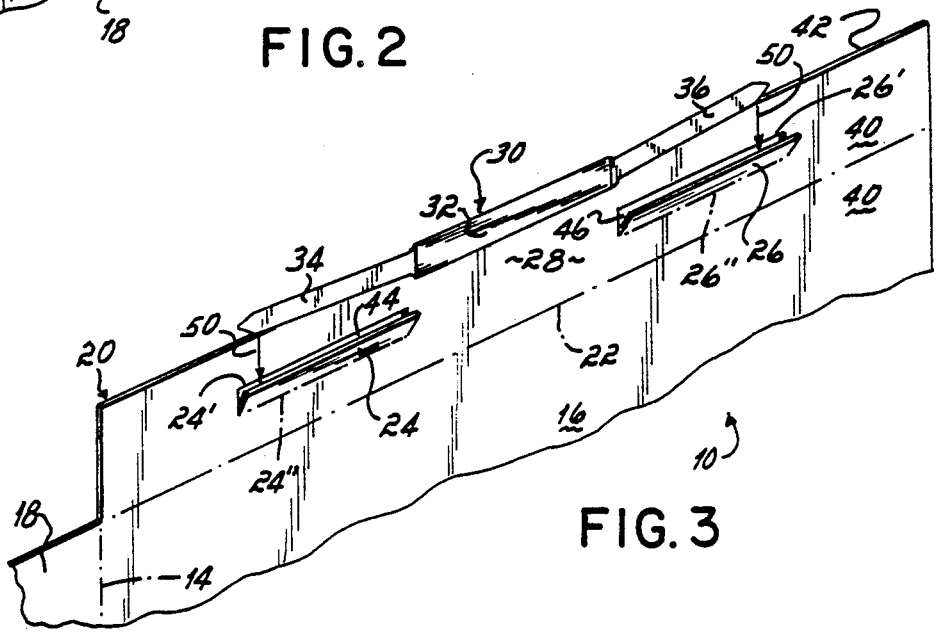
FIG. 3 is a perspective view of the top portion of the partially assembled combination of FIG. 1 illustrating the method of assembly of the fastener and folder.

With reference first to FIGS. 1–3 of the drawings, there is illustrated a file folder 10 embodying the invention of this application. The file folder 10 comprises a sheet of cardboard or other flexible file folder sheet material which is folded along a fold line 14 to form two panels 16 and 18. One of these panels 16 has a major flap 20 extending from the top edge of the panel and connected thereto by a horizontal fold line 22.

In accordance with the practice of this invention, the major flap 20 has a pair of colinearly aligned, spaced, elongated minor flaps 24, 26 formed therein and separated by a medial portion 28 of the major flap. With particular reference to FIG. 2, it will be seen that each minor flap is formed by a generally U-shaped score line 24', 26' and by a horizontal fold line 24", 26". The score lines 24", 26" connect the minor flaps 24, 26 to the major flap 20 while permitting the minor flaps to flex or fold about the fold lines.

The file folder of this invention is completed by a metal fastener 30. This fastener has a central body portion 32 and a pair of end prongs 34, 36 extending from opposite ends of the elongated central body portion 32.

In order to assemble the fastener 30 to the folder 10, the minor flaps 24, 26 are folded inwardly toward the inside surface 40 of the folder. Thereby, open slots 44, 46 are defined between the inwardly folded flaps and the inside surface 40 of the major flap. The prongs 34, 36 of the fastener 30 are then bent or angled inwardly at a slight angle, as for example, 10°, relative to the central body portion 32 of the fastener. With the flaps so folded and as illustrated in FIG. 3, the prongs 34, 36 of the fastener so bent, the fastener may be moved vertically downwardly, as indicated by the arrows 50, to insert the prongs 34, 36 of the fastener into the slots 44, 46. The central body portion 32 of the fastener is thereby located over and in juxtaposition to the medial portion 28 of the folder. A bead of adhesive 52 is then applied to the minor flaps and the end portion of the major flap outwardly of the minor flaps. Generally, this bead of adhesive will be a hot-melt adhesive. After placement of the bead of adhesive 52 (FIG. 1) on the minor flaps and the major flap, the major flap is folded inwardly and downwardly about the fold line 22 so as to position and secure the inside surface 40 of the flap to the inside surface of the folder panel 16. With the flap so positioned and secured, the central body portion 32 of the fastener 30 is secured and sandwiched between the inside surface 40 of the major flap 20 and the inside surface of the folder panel 16. The end prongs 34, 36 of the fastener are then exposed to the inside surface of the folder such that the prongs may be folded upwardly normal to the surface of the folder for placement of punched papers over the prongs. After placement of papers or other items to be filed in the folder over the prongs, the prongs may be bent downwardly against the inside surface of the folder so as to secure the papers or other materials within the folder.

Figure 4:
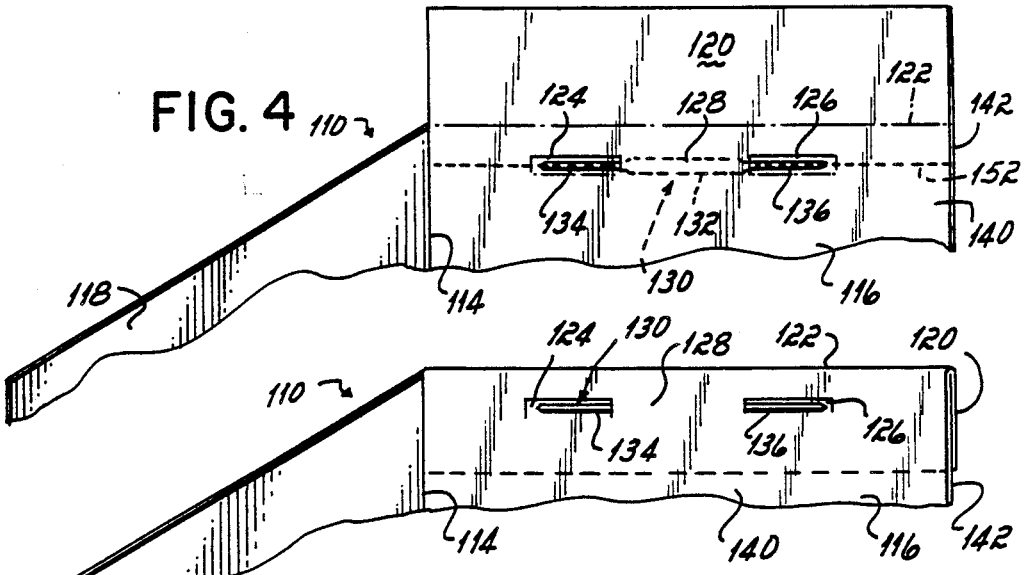
FIG. 4 is a fragmentary view similar to FIG. 1 but illustrating a second embodiment of the invention of this application.
Figure 5:
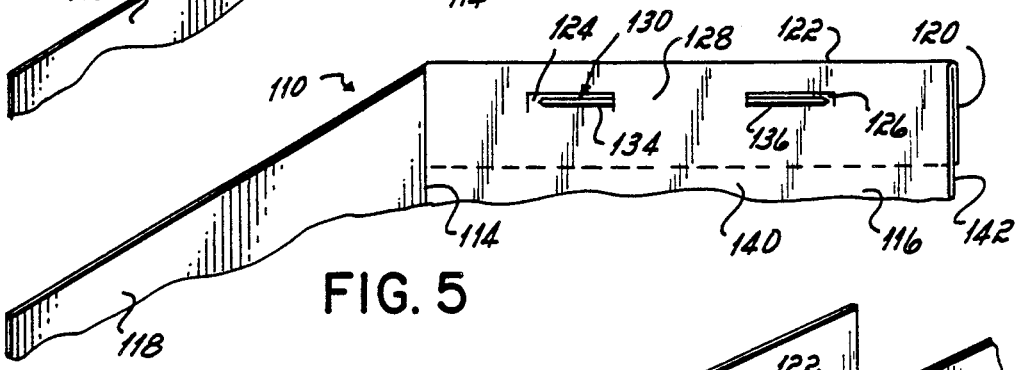
FIG. 5 is a view similar to FIG. 2 but illustrating the second embodiment of the invention.
Figure 6:
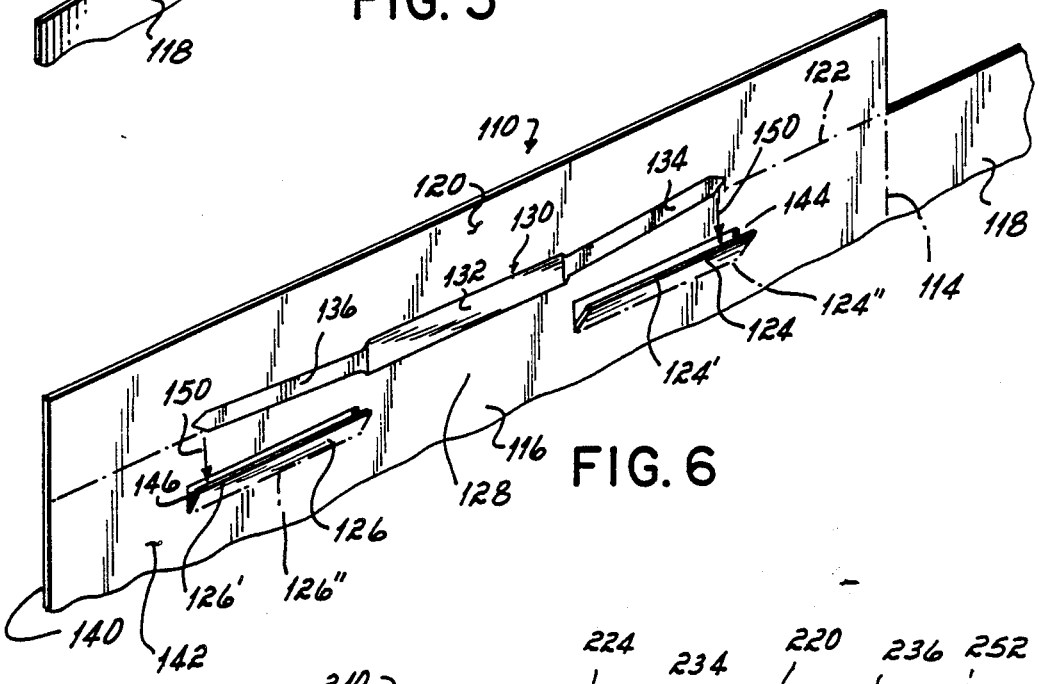
FIG. 6 is a view similar to FIG. 3 but illustrating the assembly of the second embodiment of the invention.

With reference now to FIGS. 4, 5 and 6 there is illustrated a second embodiment of this invention. This embodiment is generally identical to the embodiment of FIGS. 1–3, except that the colinearly aligned, spaced minor flaps 124, 126 are located in the panel 116 of the folder adjacent to the fold line 122, rather than being located in the major flap. The major flap in this embodiment has no minor flaps formed therein. The fastener 130 of this embodiment is inserted into the slots 144, 146 defined between the minor flaps and the outside surface 142 of the folder panel 116 with the central portion 132 of the fastener 130 located over and in juxtaposition to the outside surface of the medial portion 128 of the folder panel 116. The major flap 120 of the folder is then folded outwardly and downwardly over the outside surface 142 of the panel 116 so as to secure and sandwich the central body portion 132 of the fastener 130 between the outside surface 142 of the major flap 120 and the outside surface of the panel 116 of the folder 110. As in the case of the embodiment of FIGS. 1–3, a bead of adhesive 152 is applied to the minor flaps 124, 126 and to the folder panel 116 outboard of the minor flaps 124, 126 so as to secure the outside surface 140 of the major flap 120 to the outside surface of the panel 16 of the folder 110.

Figure 7:
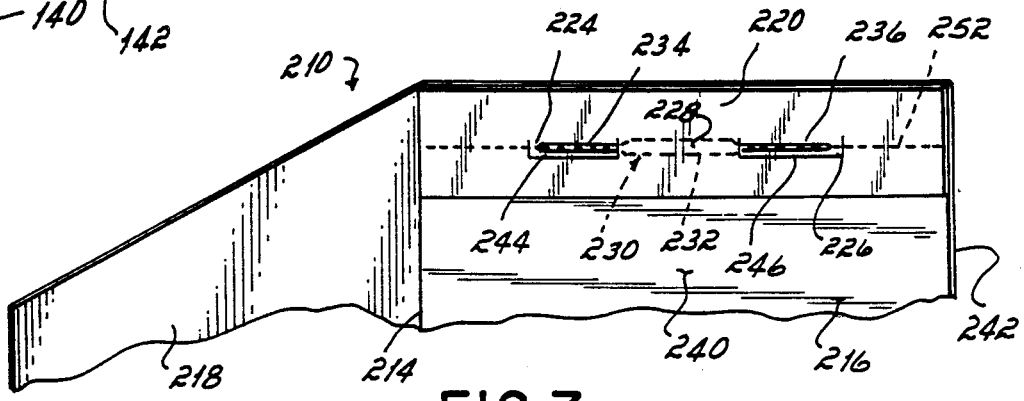
FIG. 7 is a view similar to FIG. 1 but illustrating a third embodiment of the invention wherein a separate cover strip is used in lieu of a flap of the folder.

With reference now to FIG. 7, there is illustrated still a third embodiment of this invention. This embodiment is identical to the embodiment of FIGS. 1–3 except that the minor flaps 224, 226 are formed in a separate strip 220 of folder material, rather than in a major flap attached to the folder. This separate strip, then, after placement of the fastener 230 within the slots 244, 246 defined by the outwardly folded minor flaps 224, 226 is adhered to the inside surface 240 of the panel 216 of the folder in the same fashion that the major flap was adhered to the inside surface of the panel 16 of the folder in the embodiment of FIGS. 1–3.

The novel folder of this invention has many advantages over prior art folders and fastener combinations. Among those advantages is the capability of being machine manufactured and assembled with relatively inexpensive equipment. This file folder also minimizes materials utilized to create a folder and fastener combination in which the fastener is covered and not subject to becoming entangled with adjacent file folders when the folder is placed in a drawer with numerous other similar folders.

While we have described only three preferred embodiments of the invention of this application, persons skilled in this art will appreciate still further changes and modifications which may be made without departing from the spirit of our invention. Therefore, we do not intend to be limited except by the scope of the following appended claims.

We claim:

1. In combination, a folder and a fastener for securing loose papers to the folder, said folder having a major flap along one edge of said folder, said folder and said major flap both having an inside surface and an outside surface, a pair of spaced, colinearly aligned, elongated minor flaps formed in one of said folder and said major flap, said minor flaps being separated by a medial portion of said one of said folder and said major flap, said fastener comprising a central body portion and a pair of opposed, elongated prongs extending from opposite ends of the central body portion, said fastener terminating at the ends of said prongs, said central body portion of said fastener overlying said medial portion of said one of said folder and said major flap on one surface of said one of said folder and said major flap, said prongs of said fastener overlying said minor flaps on the other surface from said one surface of said one of said folder and said major flap, said central body portion of said fastener being sandwiched and secured between said folder and said major flap with said prongs of said fastener overlying said spaced, colinearly aligned, elongated minor flaps, whereby said prongs may be bent upwardly from the inside surface of said folder for securement or removal of loose papers relative thereto and bent downwardly to retain papers mounted thereon.

2. The combination of claim 1 wherein said central body portion of said fastener is secured between said folder and said major flap by adhesive which secures said minor flaps and major flap to said folder.

3. The combination of claim 1 wherein said central body portion of said fastener is secured between said folder and said major flap by adhesive which secures said minor flaps and major flap to said folder.

4. The combination of claim 1 wherein said central body portion of said fastener is secured between said folder and said cover strip means by adhesive which secures said minor flaps and major flap to said folder.

5. The combination of claim 1 wherein said central body portion of said fastener is secured between said folder and said major flap by adhesive which secures said minor flaps and major flap to said folder.

6. In combination, a folder and a fastener for securing loose papers to the folder, said folder having a major flap along one edge of said folder, said folder and said major flap both having an inside surface and an outside surface, a pair of spaced, colinearly aligned, elongated minor flaps formed in said major flap, said minor flaps being separated by a medial portion of said major flap, said fastener comprising a central body portion and a pair of opposed, elongated prongs extending from opposite ends of the central body portion, said fastener terminating at the ends of said prongs, said central body portion of said fastener overlying said medial portion of said major flap on the inside surface of said major flap, said prongs of said fastener overlying said minor flaps on the outside surface of said major flap, said central body portion of said fastener being sandwiched and secured between said folder and said major flap with said prongs of said fastener overlying said spaced, colinearly aligned, elongated minor flaps, whereby said prongs may be bent upwardly from the inside surface of said folder for securement or removal of loose papers relative thereto and bent downwardly to retain papers mounted thereon.

7. In combination, a folder and a fastener for securing loose papers to the folder, said folder having a major flap along one edge of said folder, said folder and said major flap both having an inside surface and an outside surface, a pair of spaced, colinearly aligned, elongated minor flaps formed in one of said folder, said minor flaps being separated by a medial portion of said folder, said fastener comprising a central body portion and a pair of opposed, elongated prongs extending from opposite ends of the central body portion, said fastener terminating at the ends of said prongs, said central body portion of said fastener overlying said medial portion of said folder on the outside surface of said folder, said prongs of said fastener overlying said minor flaps on the inside surface, said central body portion of said fastener being sandwiched and secured between said folder and said major flap with said prongs of said fastener overlying said spaced, colinearly aligned, elongated minor flaps, whereby said prongs may be bent upwardly from the inside surface of said folder for securement or removal of loose papers relative thereto and bent downwardly to retain papers mounted thereon.

8. In combination, a folder and a fastener for securing loose papers to the folder, said folder having cover strip means along one edge of said folder, said folder and said cover strip means both having an inside surface and an outside surface, a pair of spaced, colinearly aligned, elongated minor flaps formed in one of said folder and said cover strip means, said minor flaps being separated by a medial portion of said one of said folder and said cover strip means, said fastener comprising a central body portion and a pair of opposed, elongated prongs extending from opposite ends of the central body portion, said fastener terminating at the ends of said prongs, said central body portion of said fastener overlying said medial portion of said one of said folder and said cover strip means on one surface of said one of said folder and said cover strip means, said prongs of said fastener overlying said minor flaps on the other surface from said one surface of said one of said folder and said cover strip means, said central body portion of said fastener being sandwiched and secured between said folder and said cover strip means with said prongs of said fastener overlying said spaced, colinearly aligned, elongated minor flaps, whereby said prongs may be bent upwardly from the inside surface of said folder for securement or removal of loose papers relative thereto and bent downwardly to retain papers mounted thereon.

* * * * *